United States Patent [19]

Meigs et al.

[11] Patent Number: 4,514,948

[45] Date of Patent: May 7, 1985

[54] THERMAL BREAK FRAME WITH LOAD TRANSFER MEMBER

[75] Inventors: William Meigs; David M. Guffey; Donald E. Brumfield, all of Selma, Ala.

[73] Assignee: Disco Aluminum Products Co., Inc., Selma, Ala.

[21] Appl. No.: 384,069

[22] Filed: Jun. 1, 1982

[51] Int. Cl.[3] ..... E02D 27/00

[52] U.S. Cl. ..... 52/397; 52/403; 52/730

[58] Field of Search ..... 52/397, 403, 404, 824, 52/730, 732

[56] References Cited

U.S. PATENT DOCUMENTS 4,008,552 2/1977 Biebuyck ..... 52/397

FOREIGN PATENT DOCUMENTS 2056759 5/1972 Fed. Rep. of Germany ..... 52/730
2504090 5/1976 Fed. Rep. of Germany ..... 52/403
2457812 10/1976 Fed. Rep. of Germany ..... 52/397
2712691 9/1978 Fed. Rep. of Germany ..... 52/397
116214 11/1969 Norway ..... 49/DIG. 1
1406537 9/1917 United Kingdom ..... 52/397

*Primary Examiner*—Henry E. Raduazo
*Attorney, Agent, or Firm*—Larson and Taylor

[57] ABSTRACT

A thermal break frame for supporting a planar object such as a pane of glass is disclosed. The thermal break frame includes a main frame member, a secondary frame member, and a thermal break material which supports the main frame member and secondary frame member in spaced relationship. The thermal break material also thermally insulates the main frame member from the secondary frame member. The planar object is held between the main frame member and the second frame member in a vertical orientation. A load transfer member is provided to support the planar object and this load transfer member is in turn supported by the main frame member so that the main frame member supports substantially all the weight of the planar object.

6 Claims, 1 Drawing Figure

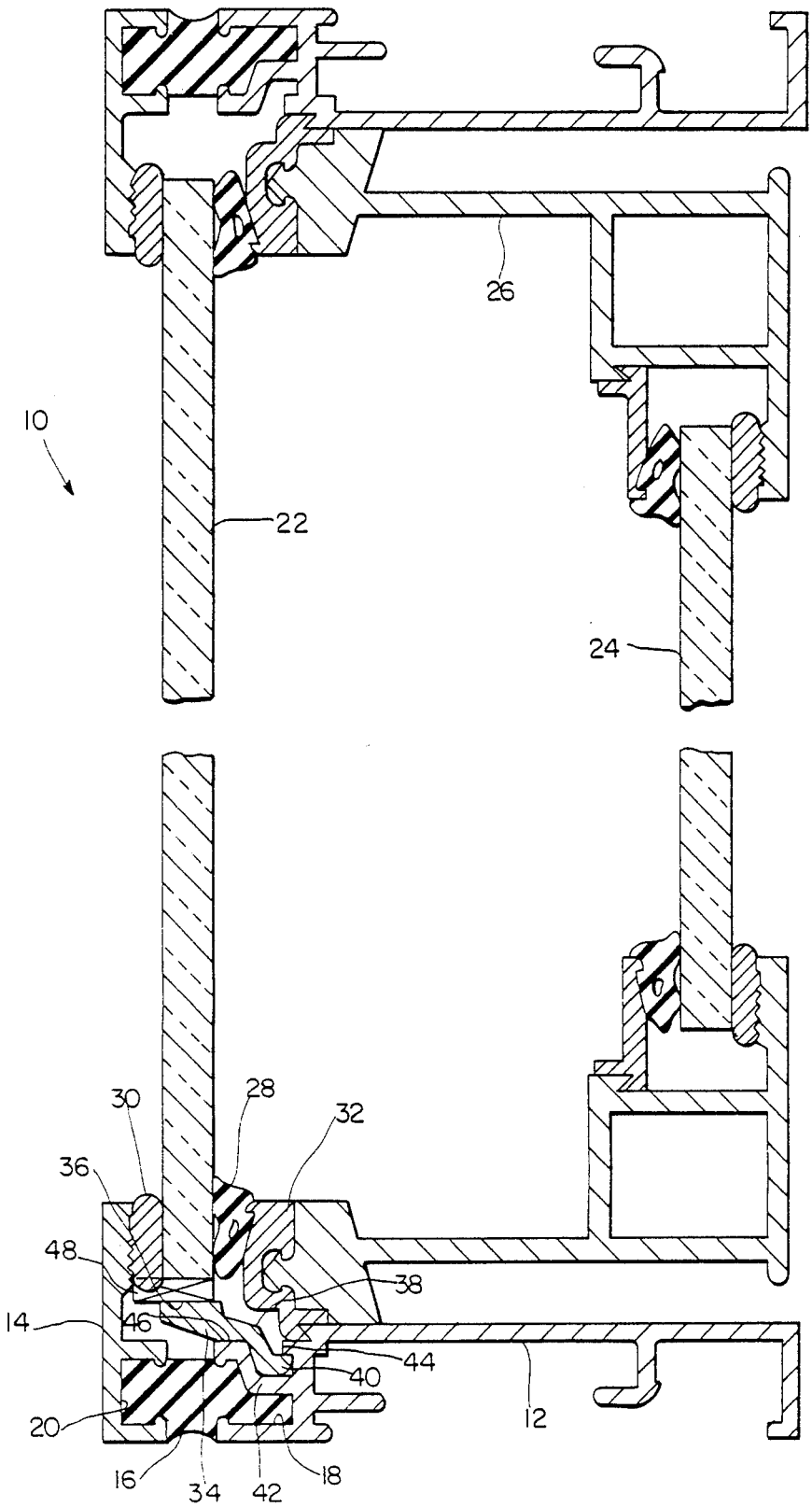
10
22
24
26
30
28
32
36
48
38
14
46
44
40
20
12
16
34
42
18

THERMAL BREAK FRAME WITH LOAD TRANSFER MEMBER

FIELD OF THE INVENTION

The present invention relates generally to frames for planar objects such as glass, and more particularly to a thermal break frame having a load transfer member such that the weight of the planar object is supported by the main frame member.

BACKGROUND OF THE INVENTION

Thermally insulated windows and similar panel structures have been disclosed in the prior art. For example, in U.S. Pat. No. 4,151,642 (Schmidt) a thermally insulated window or door assembly is provided with a centered rigid plastic to provide a thermal barrier between and to connect an interior frame member with an exterior frame member. In this patent, the double glazed window is supported by a single frame. Another type of thermally insulated window or similar supporting structure is disclosed in U.S. Pat. No. 3,686,795 (LaBarge). In this patent, an outer frame member supporting the glass is thermally insulated from the inner frame member and is movable relative thereto. The glass is supported on a plurality of setting or spacing blocks to insulate the glass from the frame.

SUMMARY OF THE INVENTION

In accordance with the present invention, a thermal break frame for supporting a planar object such as a pane of glass is disclosed. The thermal break frame includes a main frame member, a secondary frame member, and a thermal break material which supports the main frame and secondary frame members in spaced relationship and which thermally insulates them from one another. Located between the two frame members is the planar object such as a glass panel. While the weight of the glass panel could easily be supported by the thermal break material, there is some concern that the thermal break material might soften under heat. Therefore, if the thermal break material supports a structural load, it would be possible for the thermal break material to fail or take a permanent set. Therefore, the present invention provides a load transfer member which is supported by the main frame member and which in turn supports the weight of the glass panel so that it is the main frame member which bears the weight of the glass panel. In this manner, no structural load is placed upon the thermal break material or outer frame member.

According to the preferred embodiment of the present invention, the planar object rests on an insulating setting block which is in bearing contact with the load transfer member. In addition, the planar object is held between the two frame members by suitable beads which are made of a thermally insulating material so that the planar object is thermally insulated from both of the frame members. Conveniently, the thermal break material can be made of polyurethane and the frame members of extruded aluminum.

Other features and advantages of the present invention are stated in or are apparent from a detailed description of the preferred embodiment found hereinbelow.

BRIEF DESCRIPTION OF THE DRAWING

The single FIGURE is a cross-sectional side view of a thermal break window unit according to the present invention.

DETAILED DESCRIPTION OF THE PREFERRED EMBODIMENT

With reference now to the drawing, a thermal break window unit 10 having a main, interior frame member 12 and a secondary, outer frame member 14 is depicted. Interconnecting inner frame member 12 and outer frame member 14 is a thermal break material 16. Thermal break material 16 is conveniently formed in situ so that thermal break material 16 is anchored in place in lipped channels 18 and 20, respectively, of inner frame member 12 and outer frame member 14. In this manner, thermal break material 16 holds outer frame member 14 in spaced relationship to inner frame member 12 and thermally insulates outer frame member 14 from inner frame member 12. Conveniently, both inner frame member 12 and outer frame member 14 can be formed of extruded aluminum and thermal break material 16 can be formed of polyurethane.

Thermal break window unit 10 is of the double glazed variety having an outer glass panel 22 and an inner glass panel 24. Inner glass panel 24 is supported in a separate frame 26. As the provision of inner glass panel 24 does not concern the present invention, it will not be described further.

Glass panel 22 is held in place between inner frame member 12 and outer frame member 14 by an inner bead 28 and an outer bead 30. Both beads 28 and 30 are made of a thermally insulating and resilient material. A retaining member 32 which mates with a portion of inner frame member 12 resiliently urges beads 28 and 30 against glass panel 22 so that beads 28 and 30 act as seals against glass panel 22.

In order to support the vertical weight of glass panel 22, a load transfer member 34 is provided. As shown in the drawing, load transfer member 34 includes a flat horizontal surface 36, a laterally and downwardly extending portion 38, and a distal end 40. It can also be seen from the drawing that inner frame member 12 includes an upwardly and laterally extending portion 42, and a horizontally extending lip 44. The upper end of extending portion 42 and the bottom of the middle of extending portion 38 have mating horizontal surfaces denoted at 46. With this construction, the weight of glass panel 22 is supported by load transfer member 34 which bears against inner frame member 12 at horizontal surfaces 46. In addition, distal end 40 bears against lip 44 to further support the weight of glass panel 22 and to hold load transfer member 34 in place in inner frame member 12.

In the preferred embodiment, one or more setting blocks 48 are provided between horizontal surface 36 of load transfer member 34 and the bottom of glass panel 22. Setting block 48 is made of a thermally insulating material so that glass panel 22 is thermally insulated from both inner frame member 12 and outer frame member 14.

It should be noted that the vertical weight of glass panel 22 is wholly supported by inner frame member 12. Therefore, any softening of thermal break material 16 due to heat or the like has no effect on the structural support of glass panel 22. In this manner, thermal break material 16 is not required to provide any structural support, other than holding and spacing outer frame member 14 relative to inner frame member 12 which is easily done even with a weakened thermal break material 16. It should also be noted that load transfer member 34 does not interfere with the thermal break attributes of thermal break unit 10.

While the present invention has been described with respect to a thermal break window unit 10, it should be appreciated that the present invention can be used with other thermal break structures, such as doors, or in any structure where a thermal break is provided and it is desired to have the main frame member bear the load of the planar object held by the frame. Thus, although the present invention has been described in detail with respect to an exemplary embodiment thereof, it will be understood by those of ordinary skill in the art that variations and modifications can be effected within the scope and spirit of the invention.

We claim:

1. A thermal break frame for supporting a planar object such as a pane of glass, comprising:

a main frame member including a laterally extending portion and a horizontally extending lip;

a secondary frame member;

a thermal break material which supports in spaced relationship said main frame member and said secondary frame member and which thermally insulates said main frame member from said secondary frame member;

a means for holding the planar object between said main frame member and said secondary frame member in a vertical orientation; and a load transfer member including a flat horizontal surface, and a laterally and downwardly extending portion having a distal end, said extending portion bearing against said laterally extending portion of said main frame member, and said distal end of said downwardly extending portion being located beneath and bearing against said horizontally extending lip, whereby said load transfer member is supported by said main frame member and in turn supports the weight of the planar object such that the weight of the planar object is borne by said main frame member.

2. A thermal break frame as claimed in claim 1 wherein said thermal break material is polyurethane.

3. A thermal break frame as claimed in claim 2 wherein said main frame member and said secondary frame member are made of extruded aluminum.

4. A thermal break frame as claimed in claim 1 further including an insulating setting block on which the planar object rests, said setting block being in bearing contact with said load transfer member.

5. A thermal break frame as claimed in claim 4 wherein said holding means is an exterior bead and an interior bead, said beads being made of a thermally insulating material such that with said setting blocks and said beads, said planar object is thermally insulated from both said frame members.

6. A thermal break frame as claimed in claim 1 wherein said extending portions of said load transfer member and of said main frame member include mating flat horizontal surfaces.

* * * * *